US008884836B2

(12) United States Patent
Kim et al.

(10) Patent No.: US 8,884,836 B2
(45) Date of Patent: Nov. 11, 2014

(54) MULTI-BAND INTERNAL ANTENNA

(75) Inventors: Byong-Nam Kim, Kyeonggi-Do (KR); Young-Hoon Shin, Seoul (KR)

(73) Assignee: Ace Technologies Corporation, Incheon (KR)

( * ) Notice: Subject to any disclaimer, the term of this patent is extended or adjusted under 35 U.S.C. 154(b) by 518 days.

(21) Appl. No.: 12/811,485

(22) PCT Filed: Jan. 8, 2009

(86) PCT No.: PCT/KR2009/000095
§ 371 (c)(1),
(2), (4) Date: Feb. 8, 2011

(87) PCT Pub. No.: WO2009/088231
PCT Pub. Date: Jul. 16, 2009

(65) Prior Publication Data

US 2011/0181487 A1 Jul. 28, 2011

(30) Foreign Application Priority Data

Jan. 8, 2008 (KR) ..... 10-2008-0002266

(51) Int. Cl.

| | |
|---|---|
| ***H01Q 3/00*** | (2006.01) |
| ***H01Q 9/38*** | (2006.01) |
| ***H01Q 1/36*** | (2006.01) |
| ***H01Q 1/38*** | (2006.01) |
| ***H01Q 5/00*** | (2006.01) |
| ***H01Q 9/42*** | (2006.01) |

(52) U.S. Cl.
CPC . *H01Q 1/36* (2013.01); *H01Q 1/38* (2013.01); *H01Q 5/0058* (2013.01); *H01Q 5/0093* (2013.01); *H01Q 9/42* (2013.01)
USPC ..... 343/860; 343/700 MS; 343/861; 343/895

(58) Field of Classification Search
None
See application file for complete search history.

(56) References Cited

U.S. PATENT DOCUMENTS

| | | | |
|---|---|---|---|
| 5,867,126 | A | 2/1999 | Kawahata et al. |
| 6,072,435 | A | 6/2000 | Terashima et al. |

(Continued)

FOREIGN PATENT DOCUMENTS

| | | |
|---|---|---|
| JP | 1995-193417 A | 7/1995 |
| JP | 09-219610 | 8/1997 |

(Continued)

*Primary Examiner* — Trinh Dinh
(74) *Attorney, Agent, or Firm* — Edwards Wildman Palmer LLP; Kongsik Kim; Carolina E. Save

(57) ABSTRACT

A multi band internal antenna is disclosed. The antenna may include a board, an impedance matching/feeding part formed on the board, and a first radiation element joined to the impedance matching/feeding part, where the impedance matching/feeding part may include: a first matching element of a particular length that is coupled to a ground, and a second matching element of a particular length that is arranged with a distance from the first matching element and is electrically coupled to a feeding point, and where the distance between the first matching element and the second matching element may vary partially. Thus, a multi band internal antenna can be provided that utilizes coupling matching to achieve wide-band characteristics even for multi-band designs.

8 Claims, 13 Drawing Sheets

(56) References Cited

U.S. PATENT DOCUMENTS

| | | | | |
|---|---|---|---|---|
| 6,323,811 | B1 | 11/2001 | Tsubaki et al. | |
| 6,337,667 | B1 * | 1/2002 | Ayala et al. | 343/795 |
| 6,836,248 | B2 | 12/2004 | Fukushima et al. | |
| 7,400,300 | B2 * | 7/2008 | Qi et al. | 343/700 MS |
| 7,652,637 | B2 * | 1/2010 | Taki et al. | 343/700 MS |
| 7,733,271 | B2 * | 6/2010 | Moon et al. | 343/700 MS |
| 2001/0050643 | A1 * | 12/2001 | Egorov et al. | 343/702 |
| 2006/0152411 | A1 * | 7/2006 | Iguchi et al. | 343/700 MS |

FOREIGN PATENT DOCUMENTS

| | | | | | |
|---|---|---|---|---|---|
| JP | 11-205023 | A | | 7/1999 | |
| JP | 2006-197254 | A | * | 7/2006 | H01Q 1/32 |
| WO | WO-01/24316 | A1 | | 4/2001 | |

* cited by examiner

MULTI-BAND INTERNAL ANTENNA

CROSS REFERENCES TO RELATED APPLICATIONS

This application is a U.S. national phase application, pursuant to 35 U.S.C. §371 of PCT/KR2009/000095, filed Jan. 8, 2009, designating the United States, which claims priority to Korean Application No. 10-2008-0002266, filed Jan. 8, 2009. The entire contents of the aforementioned patent applications are incorporated herein by this reference.

TECHNICAL FIELD

The present invention relates to an antenna, more particularly to a multi band internal antenna.

BACKGROUND ART

In current mobile terminals, there is a demand not only for smaller sizes and lighter weight, but also for functions that allow a user access to mobile communication services of different frequency bands through a single terminal. That is, there is a demand for a terminal with which a user may simultaneously utilize signals of multiple bands as necessary, from among mobile communication services of various frequency bands, such as the CDMA service based on the 824-894 MHz band and the PCS service based on the 1750-1870 MHz band commercialized in Korea, the CDMA service based on the 832-925 MHz band commercialized in Japan, the PCS service based on the 1850-1990 MHz commercialized in the United States, the GSM service based on the 880-960 MHz band commercialized in Europe and China, and the DCS service based on the 1710-1880 MHz band commercialized in parts of Europe.

Furthermore, there is a demand for a composite terminal that allows the use of services such as Bluetooth, ZigBee, wireless LAN, GPS, etc. In this type of terminal for using services of multiple bands, a multi-band antenna is needed, which can operate in two or more desired bands. The antennas generally used in mobile terminals include the helical antenna and the planar inverted-F antenna (PIFA).

Here, the helical antenna is an external antenna that is secured to an upper end of a terminal, and is used together with a monopole antenna. In an arrangement in which a helical antenna and a monopole antenna are used together, extending the antenna from the main body of the terminal allows the antenna to operate as a monopole antenna, while retracting the antenna allows the antenna to operate as a $\lambda/4$ helical antenna. While this type of antenna has the advantage of high gain, its non-directivity results in undesirable SAR characteristics, which form the criteria for levels of electromagnetic radiation hazardous to the human body. Also, since the helical antenna is formed protruding outwards of the terminal, it is difficult to design the exterior of the terminal to be aesthetically pleasing and suitable for carrying, but a built-in structure for the helical antenna has not yet been researched.

The inverted-F antenna is an antenna designed to have a low profile structure in order to overcome such drawbacks. The inverted-F antenna has directivity, and when current induction to the radiating part generates beams, a beam flux directed toward the ground surface may be re-induced to attenuate another beam flux directed toward the human body, thereby improving SAR characteristics as well as enhancing beam intensity induced to the radiating part. Also, the inverted-F antenna operates as a rectangular micro-strip antenna, in which the length of a rectangular plate-shaped radiating part is reduced in half, whereby a low profile structure may be realized.

Because the inverted-F antenna has directive radiation characteristics, so that the intensity of beams directed toward the human body may be attenuated and the intensity of beams directed away from the human body may be intensified, a higher absorption rate of electromagnetic radiation can be obtained, compared to the helical antenna. However, the inverted-F antenna may have a narrow frequency bandwidth when it is designed to operate in multiple bands.

The narrow frequency bandwidth obtained when designing the inverted-F antenna to operate in multiple bands is resultant of point matching, in which matching with a radiator occurs at a particular point.

Thus, there is a demand for an antenna that maintains a low profile structure and overcomes the drawback of the inverted-F antenna of narrow band characteristics for more stable operation in multiple bands.

DISCLOSURE

Technical Problem

To resolve the problems in prior art described above, an objective of the present invention is to provide a multi band internal antenna that exhibits wide-band characteristics even for multi-band designs.

Another objective of the present invention is to provide a multi band le internal antenna that provides wide-band characteristics using matching by coupling.

Still another objective of the present invention is to provide a multi band internal antenna that is less affected by external factors, such as the hand effect.

Additional objectives of the present invention will be obvious from the embodiments described below.

Technical Solution

To achieve the objectives above, an aspect of the present provides an multi band internal antenna that includes: a board, an impedance matching/feeding part formed on the board, and a first radiation element joined to the impedance matching/feeding part, where the impedance matching/feeding part includes: a first matching element of a particular length that is coupled to a ground, and a second matching element of a particular length that is arranged with a distance from the first matching element and is electrically coupled to a feeding point. The distance between the first matching element and the second matching element may vary partially.

The first matching element and the second matching element may perform impedance matching by way of coupling.

The first matching element may have a structure that includes at least one bend, while the second matching element may be bent in correspondence to the bending structure of the first matching element.

The first radiation element may extend from the first matching element of the impedance matching/feeding part and may receive power from the second matching element by coupling.

The antenna can further include a second radiation element, which is formed on the board and electrically coupled to a ground, where the second radiation element may receive power from the second matching element of the impedance matching/feeding part by coupling.

In another embodiment, the antenna can further include a second radiation element, which is formed on the board and electrically coupled to the second matching element of the impedance matching/feeding part to receive power.

Another aspect of the present invention provides an multi band internal antenna that includes: a board, an impedance matching/feeding part formed on the board, and a first radiation element joined to the impedance matching/feeding part, where the impedance matching/feeding part includes: a first matching element of a particular length that is coupled to a ground, and a second matching element of a particular length that is arranged with a distance from the first matching element and is electrically coupled to a feeding point. At least one of the first matching element and the second matching element may include a multiple number of coupling elements that protrude from the first matching element or the second matching element.

Advantageous Effects

Certain aspects of the present invention can provide a multi band internal antenna that utilizes coupling matching to achieve wide-band characteristics even for multi-band designs. Also, certain aspects of the present invention can provide a multi band antenna that is less affected by external factors, such as the hand effect.

MODE FOR INVENTION

The multi band internal antenna according to certain embodiments of the present invention will be described below in more detail with reference to the accompanying drawings.

The embodiments disclosed in the present specification will be presented using as an example a multi band antenna employed in GSM service bands, PCS service bands, and WCDMA service bands. However, the multi band internal antenna according to embodiments of the present invention is not limited to the above bands, and can be made to operate for various frequency bands.

Figure 1:
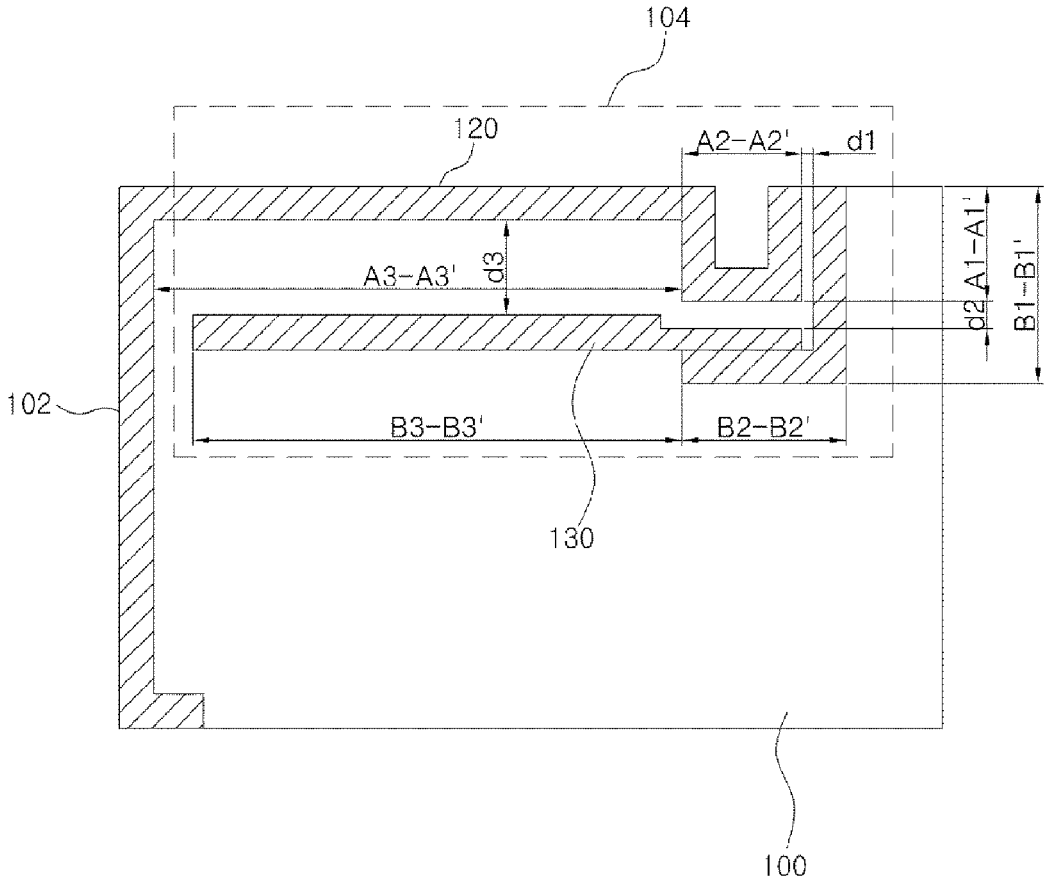
FIG. 1 illustrates the structure of a multi band internal antenna according to a first disclosed embodiment of the present invention.

FIG. 1 illustrates the structure of a multi band internal antenna according to a first disclosed embodiment of the present invention.

Referring to FIG. 1, a multi band internal antenna according to the first disclosed embodiment of the present invention can include a board 100, a radiation element 102 and an impedance matching/feeding part 104 formed on the board.

In FIG. 1, the board 100 may be made of a dielectric material, and may serve as the antenna's main body, to which the other components may be joined. A variety of dielectric materials can be applied as the board 100. For example, the board can be a PCB, FR4 board, etc.

As described above, an antenna structured as an inverted-F antenna may utilize point matching with the radiation element by way of shorting pins, etc. This point matching, however, may narrow the frequency bandwidth.

To resolve the drawback of point matching stated above, an embodiment of the present invention is presented which uses a matching method based on coupling, and which includes an impedance matching/feeding part 104 having a particular length.

The impedance matching/feeding part 104 may include a first matching element 120, which may be electrically coupled to a ground, and a second matching element 130, which may be electrically coupled to a feeding point (not shown). Coupling feeding may be performed within the impedance matching/feeding part 104 from the second matching element 130 to the first matching element 120, while signals may be radiated by the radiation element 102, which is electrically coupled to the first matching element 120.

The first matching element 120 and the second matching element 130 may be formed with a particular gap in-between, and the interaction between the first matching element 120 and the second matching element may enable coupling matching. In the interaction between the first matching element 120 and the second matching element 130, the capacitance component may play a greater role than the inductance component, and as such the present embodiment presents a structure that enables impedance matching for an wide-band by diversifying the capacitance component.

In order to diversify the capacitance component, the gap between the first matching element 120 and the second matching element 130 may be partially varied.

An example of partially varying the distance between the first matching element 120 and the second matching element 130 is shown in FIG. 1, which illustrates a structure in which the first matching element 120 is bent several times, and the second matching element 130 is bent correspondingly.

Based on the bending positions, the first matching element 120 may be divided into three sections: section A1-A1', section A2-A2', and section A3-A3'. The second matching element 130 may be bent in correspondence with the first matching element 120, and may be divided into section B1-B1', section B2-B2', and section B3-B3'.

In an embodiment of the present invention, the distance d1 between section A1-A1' and section B1-B1', the distance d2 between section A2-A2' and section B2-B2', and distance d3 between section A3-A3' and section B3-B3' are all different.

Thus, by implementing the first matching element 120 and the second matching element 130 as bending structures, and partially varying the distance in-between, wide-band characteristics by coupling matching and feeding can be obtained.

While FIG. 1 illustrates an example in which the distance between the first matching element 120 and the second matching element 130 varies partially due to bends in the first matching element 120 and the second matching element 130, it will be understood by the skilled person that this may be implemented in a variety of ways other than that illustrated in FIG. 1.

Various embodiments that include varying distance between the first matching element and the second matching element are encompassed within the scope of the present invention. In one embodiment, for example, the second matching element 130 may be formed as a straight line, while the first matching element 120 and the radiation element may be arranged diagonally, so that the distance is made to vary.

RF signals may be provide to the radiation element 102 by coupling feeding, as described above, and the radiation element 102 may radiate the signals to the exterior. The radiation element 102 may be connected to the first matching element 120 of the impedance matching/feeding part 104. Here, the transmission frequency band may be determined by the length of the radiation element 102 and the length of the impedance matching/feeding part 104.

Figure 2:
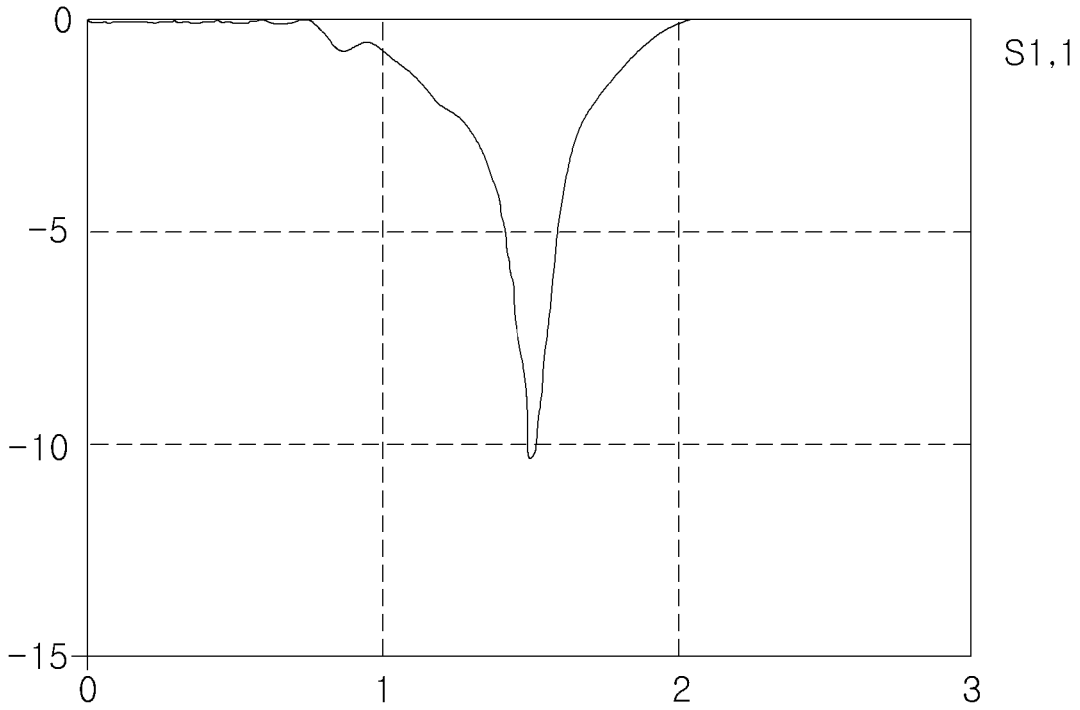
FIG. 2 represents S11 parameters of the antenna illustrated in FIG. 1.

FIG. 2 represents S11 parameters of the antenna illustrated in FIG. 1.

Referring to FIG. 2, it can be observed that the S11 parameters of the antenna illustrated in FIG. 1 represent relatively wide band characteristics.

In order to obtain wider band characteristics when utilizing matching by coupling, a structure is desired which can both diversify the capacitance component and provide a high capacitance in certain regions. This can also reduce the impact of external factors such as the hand effect by high capacitance.

Figure 3:
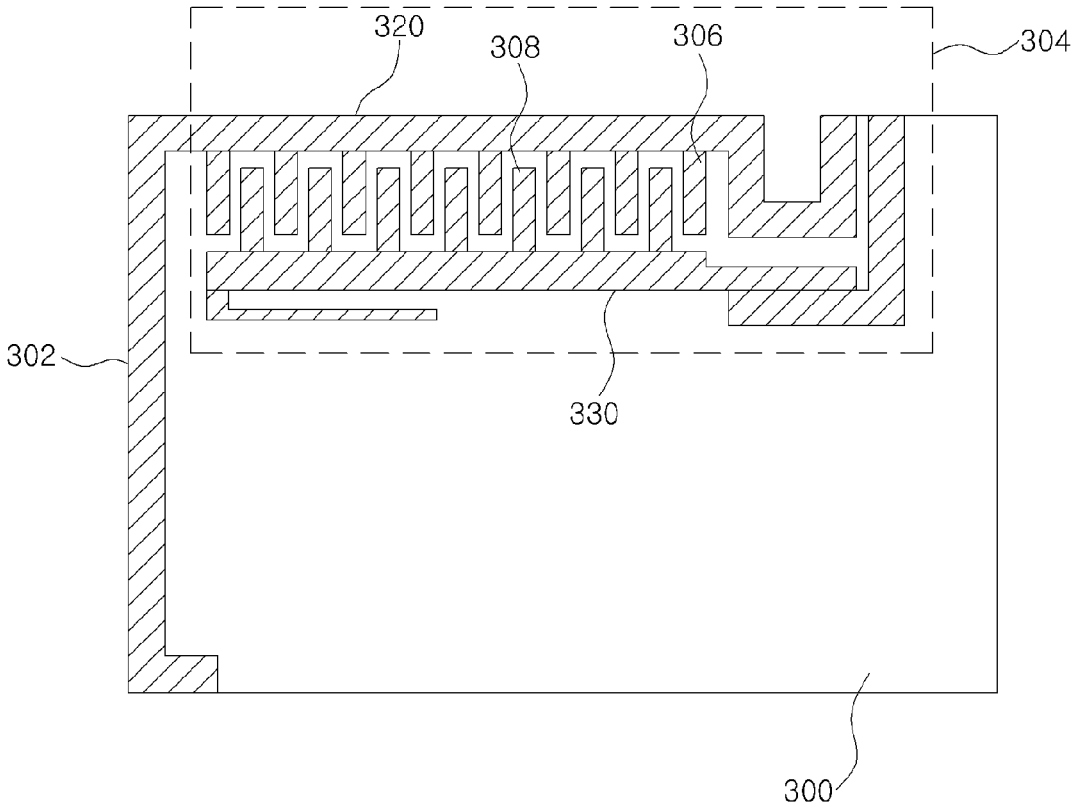
FIG. 3 illustrates the structure of a multi band internal antenna according to a second disclosed embodiment of the present invention.

FIG. 3 illustrates the structure of a multi band internal antenna according to a second disclosed embodiment of the present invention.

Referring to FIG. 3, a multi band internal antenna according to the second disclosed embodiment of the present invention may include a board 300, a radiation element 302 and an impedance matching/feeding part 304 formed on the board 300, where the impedance matching part 304 may include a first matching element 320 and a second matching element 330.

Also, a multiple number of first coupling elements 306 can be formed which protrude perpendicularly to the lengthwise direction of the first matching element 320, and a multiple number of second coupling elements 308 can be formed which protrude perpendicularly to the lengthwise direction of the second matching element.

As in the first disclosed embodiment described above, the first matching element 320 may be electrically coupled to a ground, and the second matching element 330 may be electrically coupled to a feeding point, and coupling feeding is performed from the second matching element 330 to the first matching element 320.

The multi band internal antenna according to the second disclosed embodiment of the present invention, as illustrated in FIG. 3, is structured to allow coupling by a higher capacitance.

The structure of the internal antenna according to the second disclosed embodiment of the present invention may include first coupling elements 306 and second coupling elements 308, in addition to the structure of an antenna according to the first disclosed embodiment.

The first coupling elements 306 and second coupling elements 308 enable coupling matching by a higher capacitance.

As illustrated in FIG. 3, the first coupling elements 306 and second coupling elements 308 may be formed protruding from the first matching element and second matching element in a comb-like form. In certain embodiments, the first coupling elements 306 and the second coupling elements 308 may be formed alternately, to form generally comb-like shapes.

These coupling elements 306, 308 may substantially narrow the distance between the first matching element and the second matching element, to not only provide a higher capacitance, but also aid in diversifying the capacitance component, so as to enable matching for wider bands.

Figure 4:
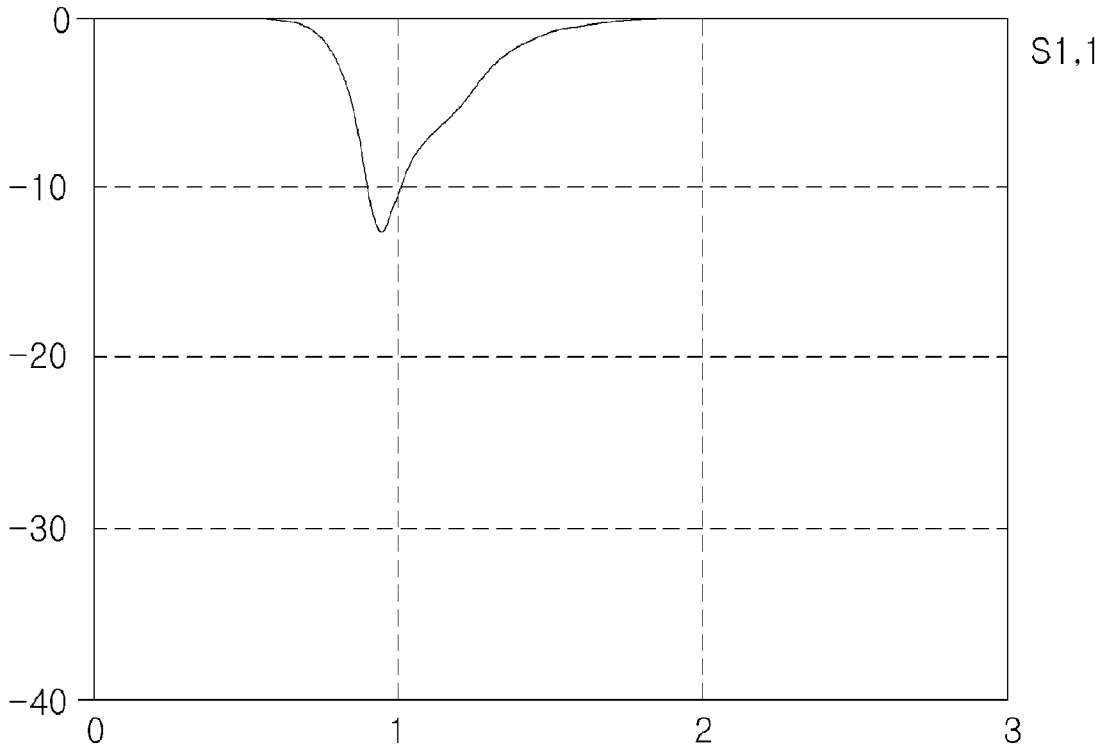
FIG. 4 represents S11 parameters of a multi band antenna according to the second disclosed embodiment of the present invention.

FIG. 4 represents S11 parameters of a multi band antenna according to the second disclosed embodiment of the present invention.

Referring to FIG. 4, it can be observed that an antenna according to the second disclosed embodiment of the present invention exhibits wider band characteristics compared to the antenna of the first disclosed embodiment illustrated in FIG. 2.

Figure 11:
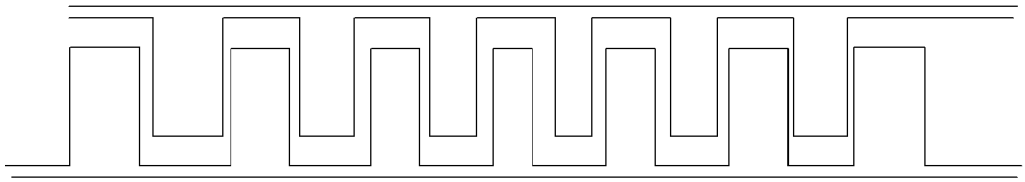
FIG. 11 through FIG. 13 illustrate structures of the first matching elements and second matching elements according to embodiments of the present invention that provide high coupling.
Figure 12:
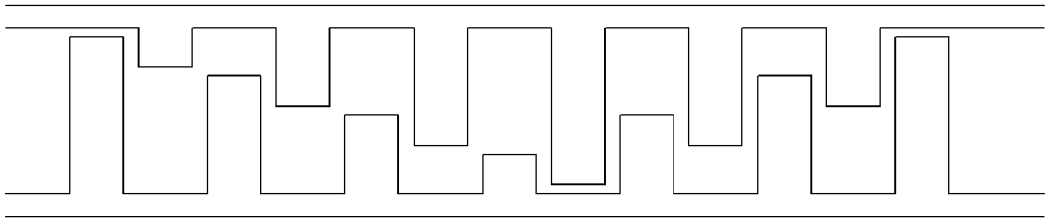
Figure 13:
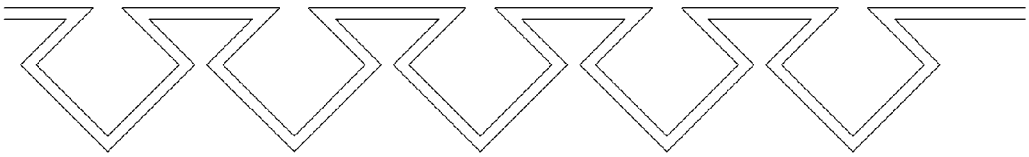

A structure for achieving greater coupling between the first matching element and the second matching element can be implemented in various ways other than by the structures illustrated in FIG. 1 and FIG. 3. FIG. 11 through FIG. 13 are drawings that illustrate structures of first matching elements and second matching elements for obtaining greater coupling according to certain embodiments of the present invention.

As illustrated in FIG. 11 through FIG. 13, the widths and lengths of the coupling elements can be varied, and as shown in FIG. 13, the coupling elements can also be implemented in shapes other than rectangles.

Figure 5:
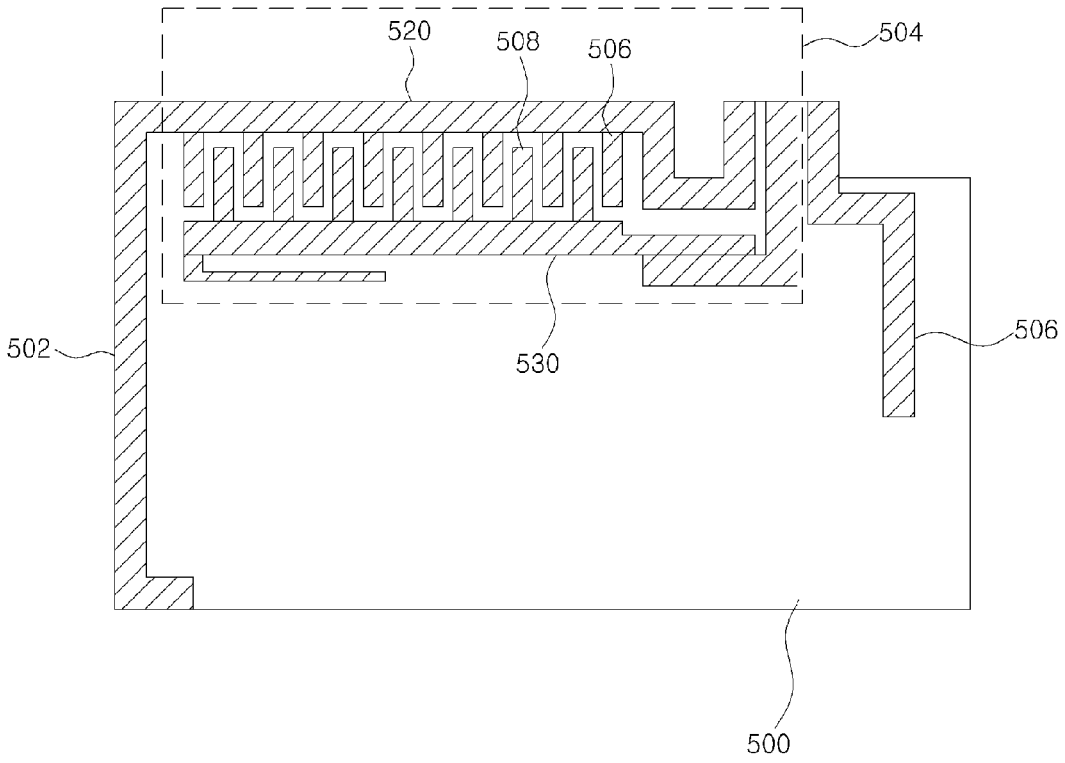
FIG. 5 illustrates the structure of a multi band internal antenna according to a third disclosed embodiment of the present invention.

FIG. 5 illustrates the structure of a multi band internal antenna according to a third disclosed embodiment of the present invention.

Referring to FIG. 5, a multi band internal antenna according to the third disclosed embodiment of the present invention may include a board 500, a first radiation element 502, an impedance matching/feeding part 504, and a second radiation element 506 formed on the board 500.

The impedance matching/feeding part 504 may include a first matching element 520, which may be electrically coupled to a ground, and a second matching element 530, which may be electrically coupled to a feeding point, where coupling elements 306, 308 may be formed protruding from the first matching element 520 and second matching element to enable matching for wider bands.

The first radiation element 502 may be formed extending from the first matching element 520 and feeding is performed by coupling.

In the third disclosed embodiment, the compositions of the first radiation element 502 and the impedance matching part 504 are substantially the same as those for the second disclosed embodiment described above, but the second radiation element 506 may be additionally included. The second radiation element 506 may be added for transmitting and receiving signals from different bands from those of the first radiation element 502.

The second radiation element 506 may be separated by a particular distance from the first radiation element 502 and the impedance matching/feeding part 504 without electrical contact. The second radiation element 506 may be electrically coupled to a ground, and may receive power by coupling from the impedance matching/feeding part 504.

FIG. 5 illustrates an example in which the second radiation element 506 is shorter than the first radiation element 502, where the second radiation element 506 may be included to transmit and receive signals in a higher frequency band than that of the first radiation element 502.

While FIG. 5 illustrates the second radiation element 506 as having one bend, it will be apparent to the skilled person that the form of the second radiation element is not thus limited.

It will be understood by the skilled person that the approach of including additional radiation elements to form resonance points in other bands can be applied not only to the second disclosed embodiment but also to the first disclosed embodiment.

Figure 6:
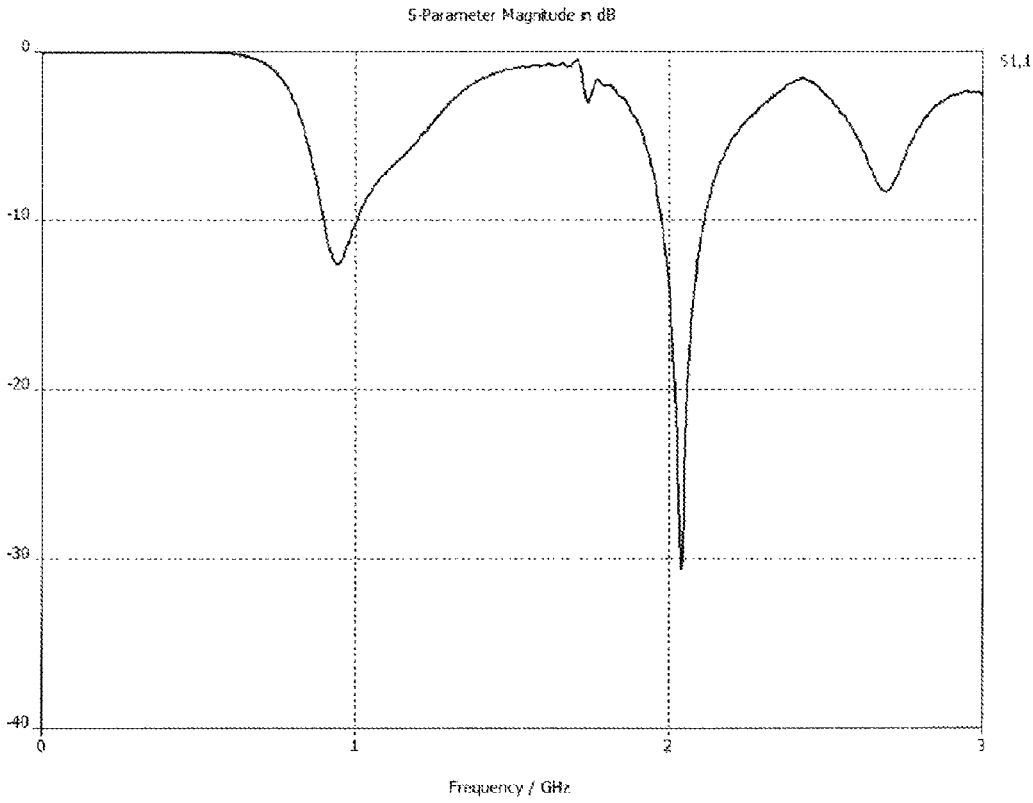
FIG. 6 represents S11 parameters of an multi band antenna according to the third disclosed embodiment of the present invention.

FIG. 6 represents S11 parameters of a multi band antenna according to the third disclosed embodiment of the present invention.

Referring to FIG. 6, it can be observed that, due to the addition of a second radiation element, resonance points have been formed at high-frequency bands. Two resonance points have been formed at high-frequency bands, and the extra resonance point is caused by a parasitic component.

Figure 7:
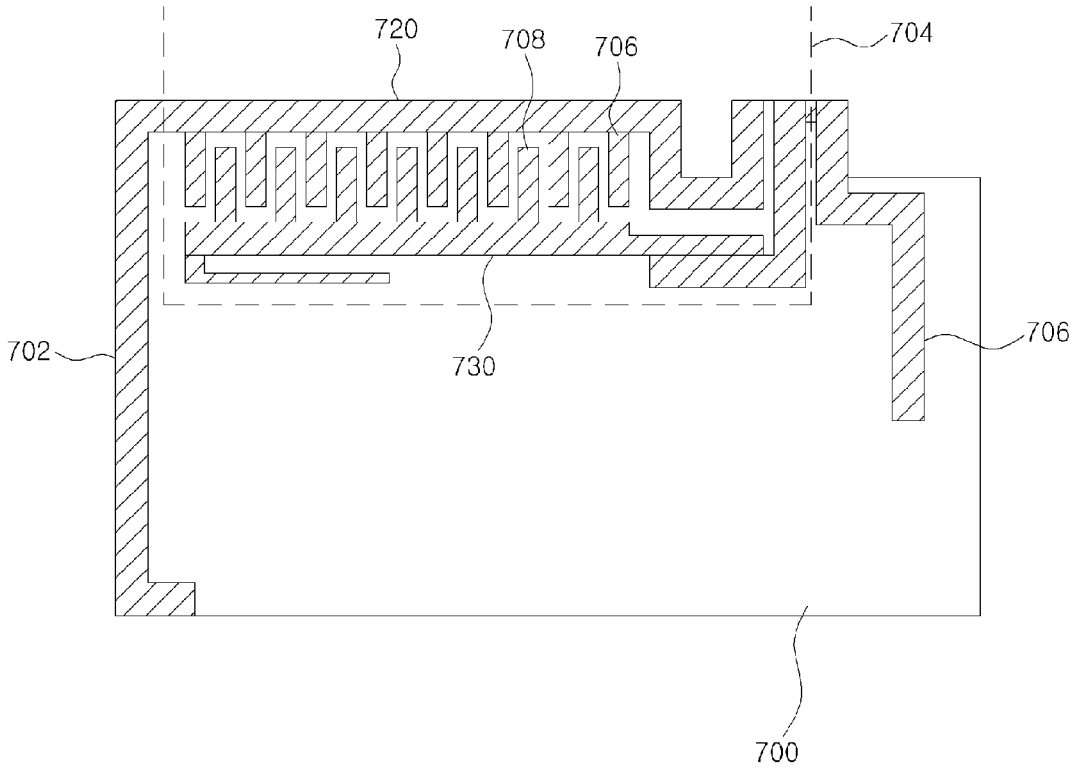
FIG. 7 illustrates the structure of a multi band internal antenna according to a fourth disclosed embodiment of the present invention.

FIG. 7 illustrates the structure of multi band internal antenna according to a fourth disclosed embodiment of the present invention.

Referring to FIG. 7, a multi band internal antenna according to the fourth disclosed embodiment of the present invention may include a board 700, and a first radiation element 702 formed on the board 700, an impedance matching/feeding part 704 formed on the board 700, and a second radiation element 706.

The impedance matching/feeding part 704 may include a first matching element 720 and a second matching element 730, the first matching element 720 electrically coupled to a ground, and the second matching element 730 electrically coupled to a feeding point.

Similar to the second and third disclosed embodiments, the first radiation element may receive RF signals from the impedance matching/feeding part through coupling feeding.

In the fourth disclosed embodiment as compared to the third disclosed embodiment, the second radiation element 706 does not receive power by coupling but by direct feeding. The second radiation element 706 may be electrically joined to the second matching element 730 of the impedance matching/feeding part 704, which is electrically coupled to a feeding point, so that direct feeding may be provided to the second radiation element 706.

Thus, when there are additional radiation elements for transmitting and receiving signals in other bands, these radiation elements can be provided with power either by coupling, as in the third disclosed embodiment, or by direct power feeding, as in the fourth disclosed embodiment.

While FIG. 7 illustrates an example in which the second matching element 730 and the second radiation element 706 are electrically joined on the board, the second matching element 730 and the second radiation element 706 do not necessarily have to be joined on the board and can be electrically joined in another region.

Also, it will be apparent to the skilled person that the approach of including additional radiation elements to form resonance points in other bands can be applied not only to the second disclosed embodiment but also to the first disclosed embodiment.

Figure 8:
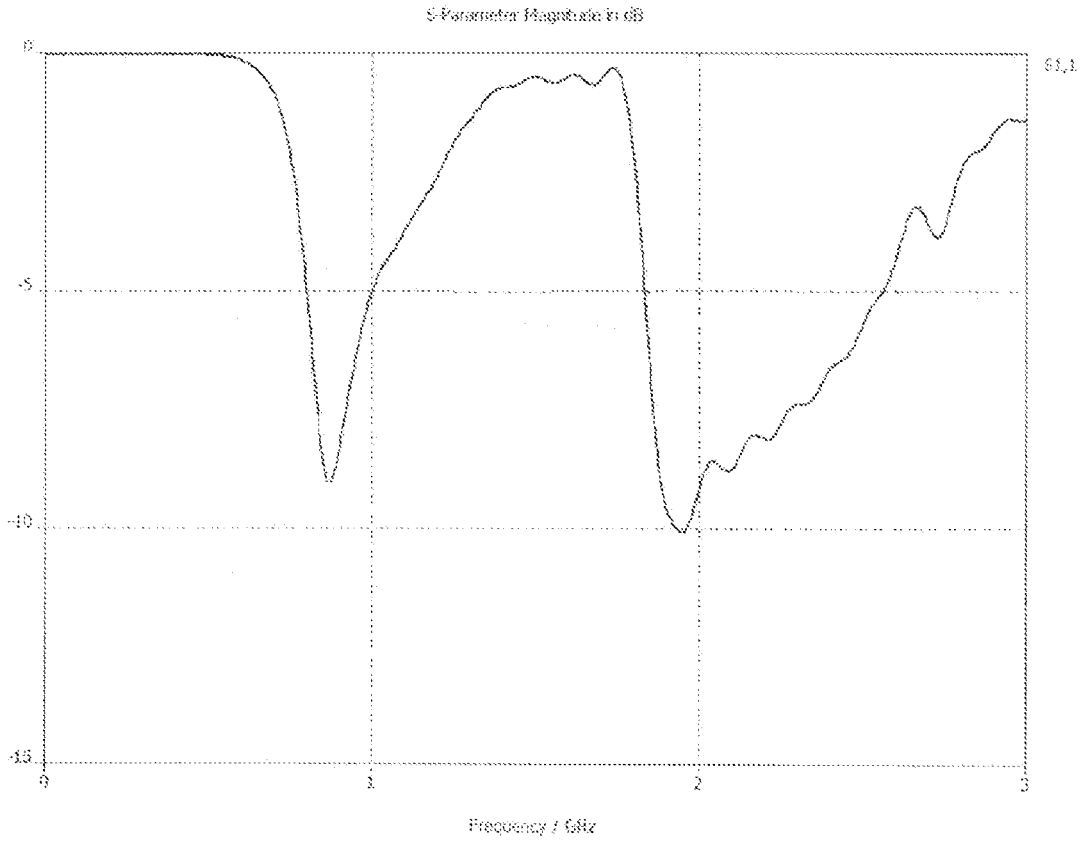
FIG. 8 represents S11 parameters of an multi band antenna according to the fourth disclosed embodiment of the present invention.

FIG. 8 represents S11 parameters of a multi band antenna according to the fourth disclosed embodiment of the present invention.

Referring to FIG. 8, it can be observed that resonance points have been formed at high-frequency bands. Unlike the third disclosed embodiment shown in FIG. 6, however, there is no extra resonance point caused by a parasitic component.

Figure 9:
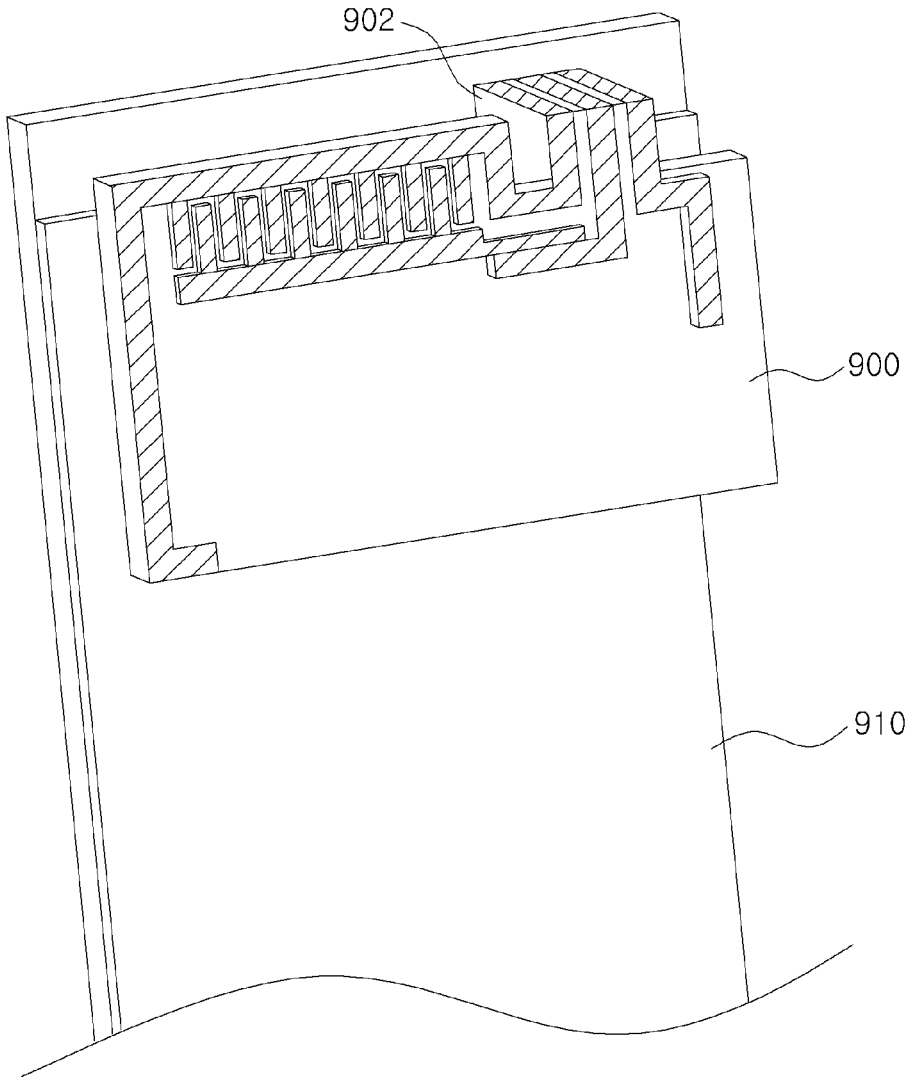
FIG. 9 illustrates a structure in which a multi band internal antenna according to the third disclosed embodiment of the present invention is joined to an antenna carrier of a terminal.

FIG. 9 illustrates a structure in which a multi band internal antenna according to the third disclosed embodiment of the present invention is joined to an antenna carrier of a terminal.

The antenna carrier may include a horizontal part 900 and a vertical part 902, where the vertical part 902 may be formed perpendicularly to the board 910 of the terminal to support the horizontal part 900, and the horizontal part 900 may be formed parallel to the board of the terminal, with the elements described above joined to the horizontal part 900.

In FIG. 9, the first matching element may extend to the vertical part 902 and join a ground of the terminal's board 910, and the second matching element may extend and electrically connect with a feeding point. Also, in cases where the second radiation element is included, the second radiation element may extend to the vertical part 902 and join the ground of the terminal's board 910.

Figure 10:
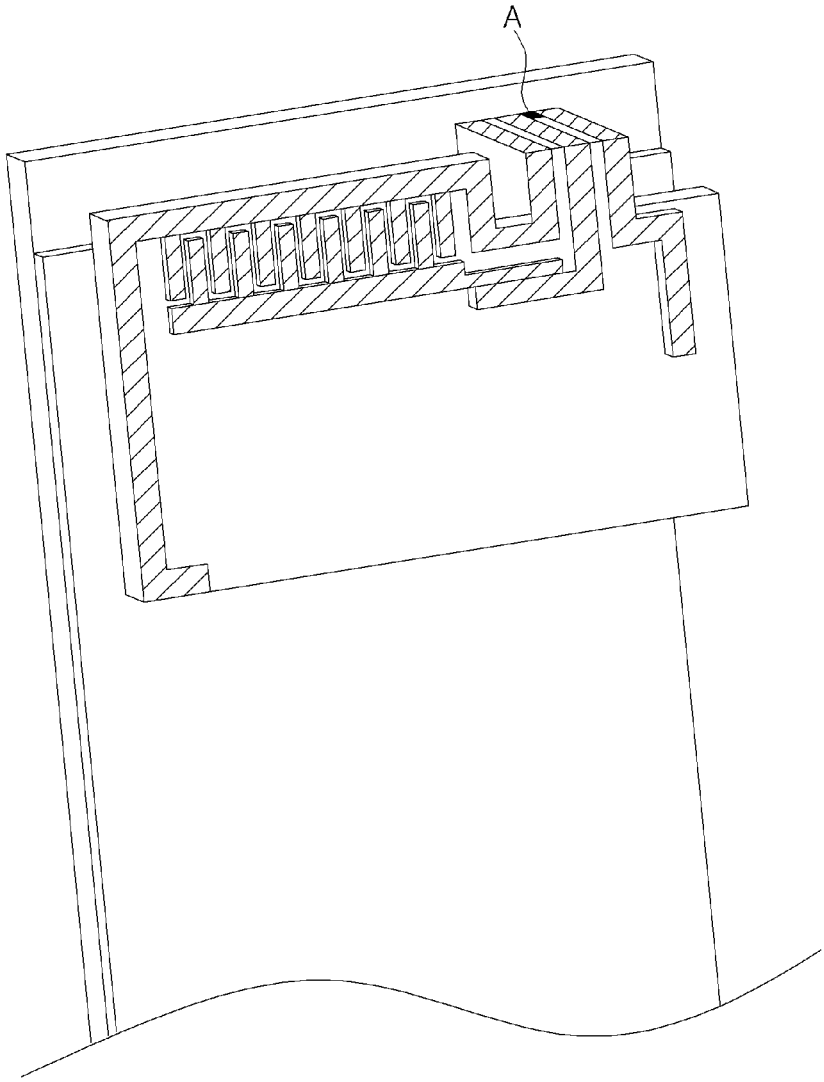
FIG. 10 illustrates a structure in which a multi band internal antenna according to the fourth disclosed embodiment of the present invention is joined to a PCB of a terminal.

FIG. 10 illustrates a structure in which a multi band internal antenna according to the fourth disclosed embodiment of the present invention is joined to a PCB of a terminal.

Referring to FIG. 10, the second radiation element and the second matching element coupled to the feeding point, according to the fourth disclosed embodiment, may be electrically joined at point A, so that direct power feeding may be provided to the second radiation element.

The embodiments of the present invention described in the above are for illustrative purposes only. It is to be appreciated that those of ordinary skill in the art can modify, alter, and make additions to the embodiments without departing from the spirit and scope of the present invention, and that such modification, alterations, and additions are encompassed in the appended claims.

The invention claimed is:

1. A multi band internal antenna comprising:

a board;

an impedance matching/feeding part formed on the board; and a first radiation element joined to and being coplanar with the impedance matching/feeding part, wherein the impedance matching/feeding part comprises:

first matching element having a particular length, one end of the first matching element being coupled to a ground and the other end is open end, and a second matching element having a particular length and arranged with a distance from the first matching element, the second matching element electrically coupled to a feeding point, and wherein one end of the first radiation element is coupled to the other end of the first matching element and the other end of the first radiation element is open, and both the first matching element and the second matching element comprise a plurality of coupling elements protruding perpendicularly from the first matching element and the second matching element to form a generally comb-like shape, and wherein the first radiation element extends from the first matching element at a starting point, the first radiation element extending away from and being coplanar with the second matching element, and wherein the second matching element terminates at the open end wherein a distance from the starting point to the open end is shorter than a distance from the starting point to any of the other points on the second matching element.

2. The multi band internal antenna of claim 1, wherein the first matching element and the second matching element perform impedance matching by way of coupling.

3. The multi band internal antenna of claim 2, wherein coupling elements protruding from the first matching element and coupling elements protruding from the second matching element are formed alternately.

4. The multi band internal antenna of claim 2, wherein coupling elements protruding from the first matching element and coupling elements protruding from the second matching element have partially varying protrusion intervals and protrusion lengths.

5. The multi band internal antenna of claim 2, wherein a distance between the first matching element and the second matching element varies partially.

6. The multi band internal antenna of claim 2, wherein the first radiation element receives power from the second matching element by coupling.

7. The multi band internal antenna of claim 2, further comprising:

a second radiation element formed on the board and electrically coupled to a ground, the second radiation element receiving power from the second matching element of the impedance matching/feeding part by coupling.

8. The multi band internal antenna of claim 2, further comprising:

a second radiation element formed on the board, the second radiation element electrically coupled to the second matching element of the impedance matching/feeding part to receive power.

* * * * *